US005172427A

United States Patent [19]

Van Bergen et al.

[11] Patent Number: 5,172,427

[45] Date of Patent: Dec. 22, 1992

[54] FINGERLESS MITTEN

[75] Inventors: Peter J. Van Bergen, Williamsburg; James C. Stewart, Christiansburg, both of Va.

[73] Assignee: Four Corners Corporation, Williamsburg, Va.

[21] Appl. No.: 725,030

[22] Filed: Jul. 3, 1991

[51] Int. Cl.[5] ..... A41D 19/00

[52] U.S. Cl. ..... 2/158; 2/123; 2/170

[58] Field of Search ..... 2/158, 208, 123, 125, 2/170, 80, 83, 114, 159, 66, 17

[56] References Cited

U.S. PATENT DOCUMENTS

| | | | |
|---|---|---|---|
| 1,014,653 | 1/1912 | Kronenberger | 2/158 X |
| 1,310,120 | 7/1919 | Kreamer | 2/158 |
| 1,404,453 | 1/1922 | Lynn | 2/161 |
| 2,274,335 | 3/1941 | Kennedy | 2/161 |
| 2,315,889 | 4/1943 | Wells | 2/161 |
| 2,323,136 | 6/1943 | Johanson | 2/161 |
| 2,469,556 | 5/1949 | Jacobson | 2/83 |
| 2,621,336 | 12/1952 | Wendroff | 2/80 X |
| 2,675,554 | 4/1954 | Gertz | 2/158 X |
| 2,677,130 | 5/1954 | O'Hayer | 2/158 X |
| 2,680,849 | 6/1954 | Munro | 2/83 X |
| 2,830,299 | 4/1958 | Thilenius | 2/158 |
| 2,836,828 | 6/1958 | Henrikson | 2/158 |
| 3,299,441 | 1/1967 | Slimovitz | 2/161 |
| 3,403,408 | 10/1968 | Helfer | 2/161 |
| 4,195,405 | 4/1980 | Monk | 2/158 |
| 4,359,784 | 11/1982 | Harrington | 2/158 X |
| 4,383,336 | 5/1983 | Beckman et al. | 2/158 |
| 4,559,647 | 12/1985 | Smith et al. | 2/158 |
| 4,683,592 | 8/1987 | Strongwater | 2/158 X |
| 4,756,027 | 7/1988 | Buenos et al. | 2/158 X |
| 4,980,929 | 1/1991 | Long | 2/158 X |
| 5,067,179 | 11/1991 | Wormser | 2/83 X |

FOREIGN PATENT DOCUMENTS

| | | | |
|---|---|---|---|
| 141441 | 4/1920 | United Kingdom | 2/158 |
| 350851 | 6/1931 | United Kingdom | 2/158 |

*Primary Examiner*—Werner H. Schroeder
*Assistant Examiner*—Sara M. Current
*Attorney, Agent, or Firm*—Peter J. Van Bergen

[57] ABSTRACT

A fingerless mitten is provided for allowing all the fingers of a hand to reside within a single defined cavity to maximize the benefits of body heat and for allowing all the fingers of the hand to be easily freed from the defined cavity while the mitten remains on the hand. A sleeve of material has coaxially aligned open ends such that one's hand can enter a first open end of the sleeve and pass freely through a second open end of the sleeve. Flap means are provided in cooperation with longitudinal portions of the sleeve and a portion of the second open end of the sleeve, whereby the single defined cavity is formed.

2 Claims, 2 Drawing Sheets

FINGERLESS MITTEN

FIELD OF THE INVENTION

The invention relates generally to hand coverings, and more particularly to a fingerless mitten.

BACKGROUND OF THE INVENTION

Hand coverings typically fall into one of two categories, namely, gloves or mittens. The advantages associated with gloves include their aesthetic appearance and a certain degree of dexterity afforded thereby. However, because the fingers on the hand are isolated from one another in separate finger stalls, gloves do not always accomplish their primary function, i.e., warmth.

In contrast, mittens generally provide a single finger stall and a separate thumb stall. In this way, the warmth characteristics of the mitten are greatly improved over those of a glove since the fingers can share body heat within the air space of the single finger stall. The separate thumb stall is generally provided to allow a certain amount of gripping action when the mitten is worn. However, the reality is that this only provides a minimal amount of dexterity. Thus, mittens must generally be removed if one is to effectively perform activities requiring a certain degree of dexterity. Such activities might include golf, fishing, hunting, to name a few.

Accordingly, over the years, several mitten designs have included a slit opening across the palm portion thereof. Such designs are disclosed in U.S. Pat. Nos. 1,404,453 to Lynn, 2,274,335 to Kennedy, 2,315,889 to Wells, 2,323,136 to Johanson, 3,299,441 to Slimovitz and 3,403,408 to Helfer. However, all of these prior art designs suffer from the same drawback, namely, the protrusion of one's hand through the slit provided in the palm portion results in approximately the top half of the mitten flapping freely. This top half of the mitten must then be restrained by the user in some fashion to prevent interruption of the activity requiring dexterity. Consequently, the use of such a prior art mitten often proves to be more trouble than it is worth to the user.

SUMMARY OF THE INVENTION

Accordingly, it is an object of the present invention to provide a mitten that provides maximum warmth characteristics while providing, without removing the mitten, the option of easily freeing one's hands to perform activities requiring dexterity.

Another object of the present invention is to provide a mitten that offers, without removing the mitten, the option of easily freeing one's hands to perform activities requiring dexterity such that feeing one's hands does not substantially interrupt the activity.

Still another object of the present invention is to provide a mitten that provides maximum warmth characteristics, has a structure that allows one to easily free one's hands without removing the mitten, and is of simple construction.

Other objects and advantages of the present invention will become more obvious hereinafter in the specification and drawings.

In accordance with the present invention, a fingerless mitten is provided for allowing all the fingers of a hand to reside within a single defined cavity to maximize the benefits of body heat and for allowing all the fingers of the hand to be easily freed from the defined cavity while the mitten remains on the hand. A sleeve of material has coaxially aligned open ends such that one's hand can enter a first open end of the sleeve and pass freely through a second open end of the sleeve. Flap means are provided in cooperation with longitudinal portions of the sleeve and a portion of the second open end of the sleeve, whereby the single defined cavity is formed.

BRIEF DESCRIPTION OF THE DRAWINGS

FIG. 5(*b*) is a cross-sectional view of the construction shown in FIG. 5(*a*) where the flap is positioned for the user availing himself of the warmth characteristics of the mitten.

DETAILED DESCRIPTION OF THE INVENTION

Figure 1:
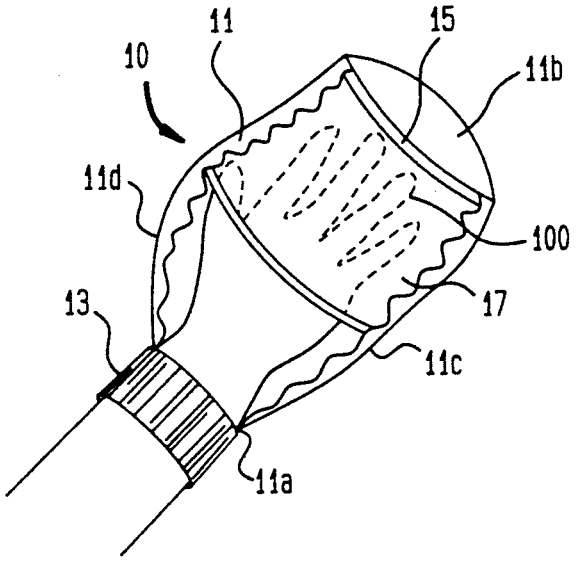
FIG. 1 is a cutaway view of the fingerless mitten of the present invention as it would be worn on a user's hand to benefit from the mitten's warmth characteristics.
Figure 2:
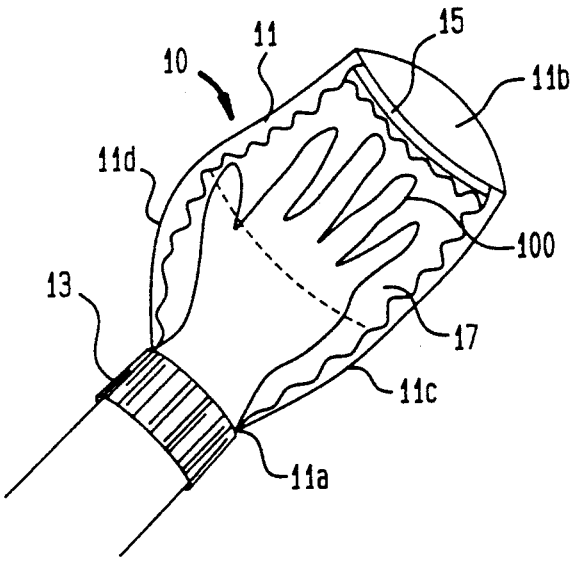
FIG. 2 is a cutaway view of the fingerless mitten of the present invention as it would be worn on a user's hand just prior to freeing his hand from the mitten.
Figure 3:
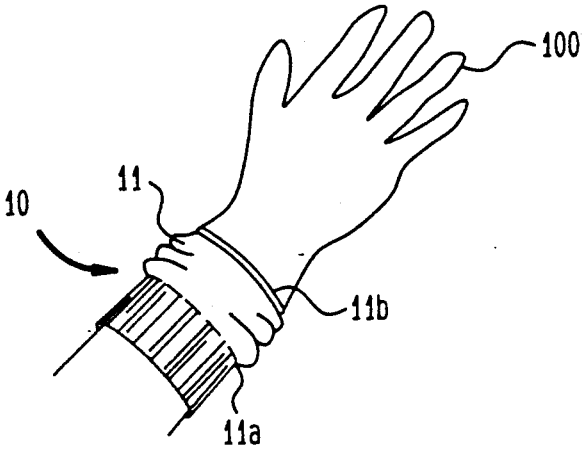
FIG. 3 is a perspective view showing the fingerless mitten as it is worn by the user once he has freed his hand.

Referring now to the drawings, and in particular to the cutaway views of FIGS. 1 and 2 and the perspective view of FIG. 3, the fingerless mitten is indicated generally by reference numeral 10. Fingerless mitten 10 is shown as it is worn on a hand 100. In particular, mitten 10 includes an open ended sleeve of material 11 that allows a user's hand 100 to enter sleeve 11 on one end 11*a* and easily pass through another end 11*b*. Accordingly, open ends 11*a* and 11*b* are longitudinally aligned for reasons that will become more apparent hereinafter.

The shape, material and construction of sleeve 11 is purely a design choice. For example, sleeve 11 could be slightly tapered at open end 11*b* as shown. Alternatively, sleeve 11 could be cylindrically shaped without any taper. It should thus be appreciated that the shape of sleeve 11 does not affect the inventive aspects of the present invention. Similarly, the material used for sleeve 11 may vary with design. Ideally, the material chosen should possess warmth characteristics required by the particular application (e.g., golf, fishing, hunting, etc.). While the number of appropriate fabrics is great, some design choices include cotton/polyester fleece, polypropylene and nylon. The construction of sleeve 11 is likewise a design choice. For example, sleeve 11 could be made from a single section of tubularly formed fabric. Alternatively, sleeve 11 could be made by sewing two body portions together along the edges 11*c* and 11*d*.

A wrist gripping cuff 13 is generally attached to the open end 11*a* in order to positively engage the wrist of hand 100. It is to be appreciated that cuff 13 may be any conventional elasticized cuff. The function of cuff 13 may alternatively be provided by a piece of elastic (not shown) sewn around open end 11*a* in order to grip the wrist. A piece of elastic 15 may also be provided along a portion of the open end 11*b*. In this way, as sleeve 11 is pulled back around the wrist, as shown in FIG. 3, elastic 15 is expanded to grip the wrist and hold sleeve 11 in place.

Mitten 10 further includes a flap 17 that will now be described with reference to FIGS. 1, 2 and 4, where like reference numerals indicate common elements. As shown in the cross-sectional view of FIG. 4, flap 17 is attached to the open end 11*b* and extends into sleeve 11. Flap 17 may be integral with sleeve 11 as shown or, alternatively, may be a separate piece of material sewn to open end 11*b*. To keep flap 17 in place, flap 17 is generally also attached to edges 11*c* and 11*d* of sleeve 11. An alternative construction is shown in the cross-section view of FIG. 5(*a*), where like reference numerals are again used for common elements.

Specifically, open ends 11*a* and 11*b* are coaxially aligned and flap 17 is formed integrally with (or attached to) the open end 11*b* such that it extends on the outside of sleeve 11. Similar to the construction shown in FIG. 4, flap 17 is generally also attached to the edges 11*c* and 11*d* of sleeve 11.

Figure 4:
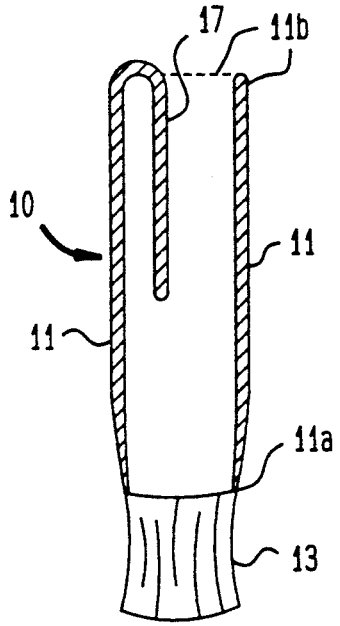
FIG. 4 is a cross-sectional view of one construction of the fingerless mitten of the present invention.
Figure 5A:
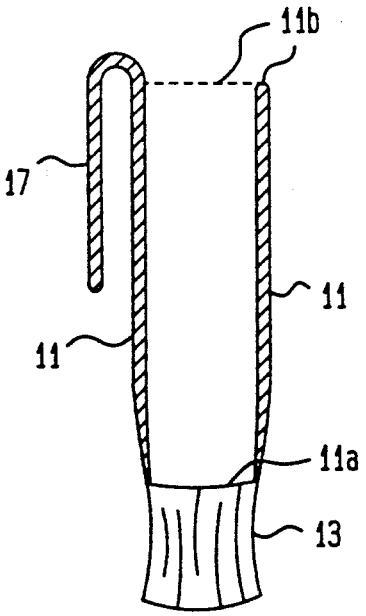
FIG. 5(*a*) is a cross-sectional view of an alternative construction of the fingerless mitten of the present invention.
Figure 5B:
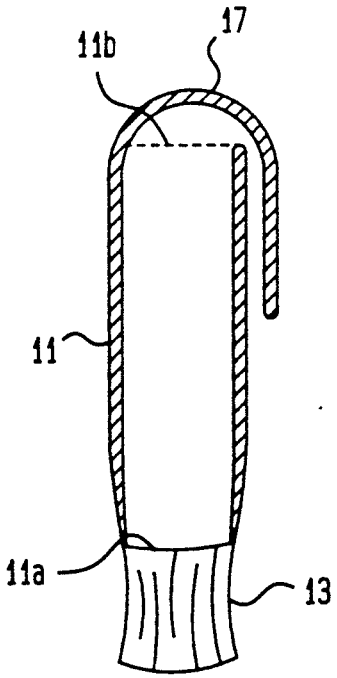

In operation, if the user wants to benefit from the warmth characteristics of mitten 10 constructed as shown in FIG. 4, the user places his hand 100 within a cavity defined by the sleeve 11 and flap 17 as illustrated in FIG. 1. If the user needs the dexterity of his fingers, he simply removes his hand from the cavity, as shown in FIG. 2, and pulls back the sleeve 11 from his hand 100 as shown in FIG. 3. The elastic 15 provided at open end 11*b* holds sleeve 11 in place around one's wrist. In this way, the user can easily pursue his activity without obstruction by mitten 10. The above described operation is simply reversed when the user wishes to again avail himself of the mitten's warmth characteristics. The operation of the construction shown in FIG. 5(*a*) is slightly different. In particular, if the user wishes to avail himself of the mitten's warmth characteristics, flap 17 is turned inside-out about open end 11*b* to enclose sleeve 11 as shown in FIG. 5(*b*). To free his hands, the user simply reverses flap 17.

The advantages of the present invention are numerous. Maximum warmth characteristics can be achieved by providing a fingerless mitten construction. In this way, all the fingers on one's hand (including the thumb) can benefit from shared body heat within the mitten. In addition, the open ends of the mitten sleeve are longitudinally aligned to allow the hand to easily pass through from one end to the other without actually removing the mitten. Thus, the construction eliminates the restraining problem associated with prior art mittens provided with slits in the palm portion thereof. Furthermore, while the invention has been discussed relative to activities requiring dexterity, it is not so limited in utility. For example, a runner, bicyclist or hiker could avail himself of the warmth characteristics of the mitten until such time that his hands were sufficiently warm. The mittens could then simply be pulled back onto the user's wrists. The mittens of the present invention could also be utilized by military field personnel.

Finally, although the invention has been described relative to specific embodiments thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A fingerless mitten comprising:

a mitten body defined by first and second sleeve portions that terminate in a common end plane, said first sleeve portion being open on a first end and closed on a second end thereof to define a continuum of air space within said first sleeve portion that surrounds the four fingers and thumb of a wearer's hand, said second sleeve portion being formed integral with and adjacent to said first sleeve portion, said second sleeve portion further being open on a first end adjacent to the first end of said first sleeve portion and open on a second end adjacent to the second end of said first sleeve portion, the second ends of said first and second sleeve portions further lying in the common end plane of said mitten body; and wrist gripping means joined to said mitten body at peripheral portions of the first ends of said first and second sleeve portions, wherein the hand of the wearer passes through said wrist gripping means to selectively enter the first end of one of said first or second sleeve portions.

2. A fingerless mitten as in claim 1 further comprising elastic means attached to the second end of said second sleeve portion.

* * * * *